US011045689B2

(12) United States Patent
Blinova

(10) Patent No.: US 11,045,689 B2
(45) Date of Patent: Jun. 29, 2021

(54) MULTIDIMENSIONAL MOBILIZATION OF LUMBAR, PELVIC, AND HIP JOINTS

(71) Applicant: Iana Blinova, New York, NY (US)

(72) Inventor: Iana Blinova, New York, NY (US)

( * ) Notice: Subject to any disclaimer, the term of this patent is extended or adjusted under 35 U.S.C. 154(b) by 0 days.

(21) Appl. No.: 16/558,118

(22) Filed: Sep. 1, 2019

(65) Prior Publication Data

US 2019/0381357 A1 Dec. 19, 2019

Related U.S. Application Data

(63) Continuation of application No. 15/887,803, filed on Feb. 2, 2018, now abandoned, which is a continuation (Continued)

(51) Int. Cl.

| | |
|---|---|
| ***A63B 26/00*** | (2006.01) |
| ***A63B 23/02*** | (2006.01) |
| ***A63B 23/04*** | (2006.01) |
| ***A63B 22/18*** | (2006.01) |
| ***A63B 21/00*** | (2006.01) |
| ***A61H 1/00*** | (2006.01) |
| ***A61H 1/02*** | (2006.01) |

(Continued)

(52) U.S. Cl.

CPC ..... *A63B 26/00* (2013.01); *A61H 1/005* (2013.01); *A63B 21/4033* (2015.10); *A63B 22/18* (2013.01); *A63B 23/0238* (2013.01); *A63B 23/0482* (2013.01); *A61H 1/0244* (2013.01); *A61H 1/0292* (2013.01); *A61H 2201/1253* (2013.01); *A61H 2201/1628* (2013.01); *A61H 2201/1661* (2013.01); *A61H 2203/0425* (2013.01); *A61H 2203/0456* (2013.01); *A63B 2023/006* (2013.01); *A63B 2071/0694* (2013.01); *A63B 2208/0228* (2013.01); *A63B 2208/0247* (2013.01); *A63B 2208/0252* (2013.01); *A63B 2208/0257* (2013.01); *A63B 2208/0266* (2013.01)

(58) Field of Classification Search

CPC ..... A63B 26/003; A63B 19/00–04; A63B 21/0004; A63B 21/4039; A63B 22/0087; A63B 22/18; A47C 7/029

See application file for complete search history.

(56) References Cited

U.S. PATENT DOCUMENTS

| | | | |
|---|---|---|---|
| 2,930,430 | A | 3/1960 | Bloom |
| 3,451,672 | A | 6/1969 | Kazdan |

(Continued)

FOREIGN PATENT DOCUMENTS

| | | | |
|---|---|---|---|
| GB | 2458190 | A | 9/2009 |
| JP | HO9-135921 | A | 5/1997 |
| WO | 01/30297 | A1 | 5/2001 |

OTHER PUBLICATIONS

Pelvic Exercise Set, Model 7560, Jan. 14, 2015.

(Continued)

*Primary Examiner* — Jennifer Robertson

(74) *Attorney, Agent, or Firm* — Giaccio LLC; Anthony Giaccio

(57) ABSTRACT

A device for multidimensional mobilization of lumbar, pelvic, and hip joints with a generally concave upper surface connected to a generally convex lower surface is disclosed, wherein the generally concave upper surface has a recess to cradle a sacrum.

2 Claims, 10 Drawing Sheets

Related U.S. Application Data of application No. 14/737,829, filed on Jun. 12, 2015, now abandoned.

(51) Int. Cl.
*A63B 23/00* (2006.01)
*A63B 71/06* (2006.01)

(56) References Cited

U.S. PATENT DOCUMENTS

| | | | |
|---|---|---|---|
| 4,752,067 | A | 6/1988 | Colonello |
| 4,756,067 | A | 7/1988 | Howell et al. |
| 4,848,742 | A | 7/1989 | Lindley et al. |
| 5,070,865 | A | 12/1991 | Iams |
| D343,877 | S | 2/1994 | Yin et al. |
| 5,337,427 | A | 8/1994 | Pagano et al. |
| 5,630,778 | A | 5/1997 | Barreca |
| 5,702,333 | A | 12/1997 | Waldron et al. |
| 5,887,951 | A | 3/1999 | Willingham |
| 7,216,388 | B2 | 5/2007 | Bieganek et al. |
| 7,335,085 | B2 | 2/2008 | Lyman |
| 7,374,517 | B2 | 5/2008 | Lockett |
| 7,695,407 | B2 | 4/2010 | Miller et al. |
| 8,632,445 | B2 | 1/2014 | Kim et al. |
| 8,678,985 | B2 | 3/2014 | Mattox |
| 8,827,881 | B2 | 9/2014 | Marino |
| 8,840,531 | B2 | 9/2014 | Viselman |
| 2003/0148865 | A1 | 8/2003 | Handshoe |
| 2004/0229731 | A1 | 11/2004 | Mitchell |
| 2006/0097555 | A1 | 5/2006 | Meleger |
| 2007/0111862 | A1 | 5/2007 | Lockett |
| 2008/0064578 | A1 | 3/2008 | Huang |
| 2009/0143205 | A1 | 6/2009 | Jahns |
| 2009/0215596 | A1 | 8/2009 | Obermaier |
| 2011/0277246 | A1* | 11/2011 | Willingham ..... A47C 7/029 5/653 |
| 2013/0274080 | A1 | 10/2013 | Matsushita |
| 2014/0228187 | A1 | 8/2014 | Moscarello |
| 2014/0256526 | A1* | 9/2014 | Henson ..... A63B 26/003 482/146 |

OTHER PUBLICATIONS

PT Board by OPTP, Jun. 12, 2015.
Back Aid Sacro Stabilizer by Sacro Wedgy, Jun. 12, 2015.
Core 930 Adult Pelvic Sacral Block by Core Products, Jun. 12, 2015.
Pain Relief Device by VacuPractor, Jun. 12, 2015.
Supplementary European Search Report from related EP 16808035 (2 pages).

* cited by examiner

MULTIDIMENSIONAL MOBILIZATION OF LUMBAR, PELVIC, AND HIP JOINTS

CROSS-REFERENCE TO RELATED APPLICATIONS

This application is a continuation of U.S. application Ser. No. 15/887,803 filed Feb. 2, 2018, currently pending, which is a continuation of U.S. application Ser. No. 14/737,829 filed Jun. 12, 2015, currently abandoned, the entire contents of which are hereby incorporated by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

Field of the Invention

This invention generally relates to a device for improving a person's physical well-being and flexibility, and for physical rehabilitation, physical therapy, and sports medicine equipment designed for mobilization of lumbar, pelvic, and hip joints, and methods of use related thereto.

Description of Related Art

A sedentary lifestyle decreases the mobility of a person's lumbar, pelvic, and hip joints, which often leads to extraordinarily painful and physically debilitating chronic conditions of the lumbar, pelvis, and hips, including but not limited to Sciatica, Scoliosis, Sacroiliac Joint Dysfunction, Spinal Stenosis, Sacroiliitis, Piriformis Syndrome, Spondyloysis, Spondylolesthesis, and Greater Trochanteric Pain Syndrome (also known Astrochanteric Bursitis). Some of these conditions may also be brought on by other causes, such as traumatic injury, arthritis, and pregnancy. Typically, these chronic conditions are treated with medications, acupuncture, chiropractic manipulation, and physical therapy regimes that have been less than optimal in curing or even alleviating these conditions.

There has been a long felt need in the physical rehabilitation, physical therapy, and sports medicine industries to develop a natural way to manage recurring pain of the lower back, pelvis, and hips without the need for anti-inflammatory medication. Traditional exercise equipment and traditional techniques have not provided an adequate solution. In addition, there has been a long felt need to improve a person's general health and well-being through the routine stretching and mobilization of the lumbar, pelvis, and hip joints to improve posture and flexibility, and in some instances to decrease the onset of pain of the lower back, pelvis, and hips.

U.S. Pat. No. 8,678,985 discloses a balance training and exercise device with a rigid, shallow concave disc having an upper concave surface and a lower convex surface, such that the upper concave surface is adapted to accommodate a user's feet or knees and the lower convex surface is adapted to contact the ground. Both the upper surface and lower surface can be modified to include ridges, bumps, channels, and similar modifications. It further discloses other prior balance and exercise devices, including a stability ball (a large spherical ball made of burst resistant material) and a semicircular stability ball (a circular rigid, non-deformable platform attached on one side to a semispherical portion made of burst resistant material) for use with hands, feet, and knees.

U.S. Pat. No. 4,848,742 discloses an exercise apparatus upon which the user rests his or her hips and feet while lying on a flat surface such as a floor. It provides means by which a user can pull or push using hands and feet while the user oscillates, rocks, or rotates his or her body to stretch or relax the user's back muscles.

There are a couple of products currently offered for sale by different manufacturers. OPTP sells a product called PT Board, which contains a swivel base to allow for 360 degrees of movement as well as side-to-side or front-to-back movement and varying degrees in between. Sacro Wedgy sells a product called Back Aid Sacro Stabilizer, which is a contoured wedge to stabilize the sacrum in its normal position of balance. Core Products sells a product called Core 930 Adult Pelvic Sacral Block, which is a foam, positioning wedge. VacuPractor sells a product called back Pain Relief Device, which is a stretching board to decompress the spine and stretch surrounding muscles.

There are a number of physical therapy techniques to manage recurring pain of the lower back, pelvis, and hips by movement of the joints of the pelvic girdle: L5-S1 Lumbosaccral Joint, Sacroiliac Joint, and Pubic Symphysis. Known techniques for mobilizing the pelvic girdle include spinal and hip extension, spinal and hip flexion, lumbar flexion also known as anterior pelvic tilt (which increases lumbar lordosis), lumbar extension also known as posterior pelvic tilt (which decreases lumbar lordosis), lateral pelvic tilt (which drops one iliac crest below the other), internal and external hip rotation (which rotates around an axis or center), nutation of the sacroiliac joint (which causes sacral flexion), and counter-nutation of the sacroiliac joint (which causes sacral extension). These techniques are performed while the patient is lying on a flat surface, either in a supine, prone, or side position, as well as in quadruped, half kneeling, and standing positions. There is also a yoga position called Supported Setu Bandha Sarvangasana, which is a spinal and hip extension whereby an individual lies on a flat surface, places his or her feet of the flat surface, and elevates his or her hips so that a rectangular foam or wood yoga block is placed on the floor under the individual to provide support to the individual's elevated hips.

BRIEF SUMMARY OF THE INVENTION

The present invention relates to a device for multidimensional mobilization of lumbar, pelvic, and hip joints comprising a generally concave upper surface connected to a generally convex lower surface, wherein the generally concave upper surface has a recess to cradle a sacrum. The present invention further relates to a device wherein the recess to cradle the sacrum has a bilateral symmetry and is elliptical, ovate, triangular, or trapezoidal in contour, wherein the device is made of one or more materials selected from the group consisting of rubber, plastic, and wood, and wherein the generally concave upper surface and the generally convex lower surface are made of different materials.

The present invention further relates to a device for multidimensional mobilization of lumbar, pelvic, and hip joints comprising a generally concave upper surface connected to a generally convex lower surface, wherein the generally concave upper surface has a recess to cradle a sacrum, and having a lip formed between the generally concave upper surface and the generally convex lower surface. The present invention further relates to a device wherein the lip limits the degree of tilting of the device from a neutral position when the generally concave upper surface is in a position substantially parallel to the ground or other flat surface, to between about 25 degrees to about 30 degrees of tilt when the generally concave upper surface is in about 25 degrees to about 30 degrees of tilt in relation to the ground or other flat surface, wherein the convex lower surface has a pre-set pattern of ridges, grooves, or planar portions, wherein the pre-set pattern of ridges, grooves, or planar portions are generally equidistant and form a half spherical polyhedron with twelve regions, and wherein the ridges, grooves, or planar portions converge at the half spherical polyhedron nadir.

The present invention relates to a device for multidimensional mobilization of lumbar, pelvic, and hip joints comprising a generally concave upper surface connected to a generally convex lower surface, wherein the generally concave upper surface has a recess to cradle a sacrum, and having indicia on the upper surface. The present invention further relates to a device wherein the indicia comprises markings selected from the groups consisting of numbers of a face of a clock, letters of a compass, and directional arrows of a compass.

The present invention relates to a device for multidimensional mobilization of lumbar, pelvic, and hip joints comprising a generally concave upper surface connected to a generally convex lower surface, wherein the generally concave upper surface has a recess to cradle a sacrum, and having a sidewall around the periphery of the generally concave upper surface. The present invention further relates to a device comprising indicia on the sidewall, wherein the indicia comprises markings selected from the groups consisting of numbers of a face of a clock, letters of a compass, or directional arrows of a compass.

The present invention relates to methods of multidimensional mobilization of lumbar, pelvic, and hip joints comprising the steps of lying supine on a flat surface with the device of claim 1 beneath the user's sacrum, and performing one or more of anterior pelvic tilt, posterior pelvic tilt, left lateral pelvic tilt, right lateral pelvic tilt, pelvic and hip rotation, and diagonal pelvic tilt stretches.

BRIEF DESCRIPTION OF THE DRAWINGS

For a better understanding of the present invention, reference is made to the following examples and drawings. Referring to the appended drawings.

Figure 1:
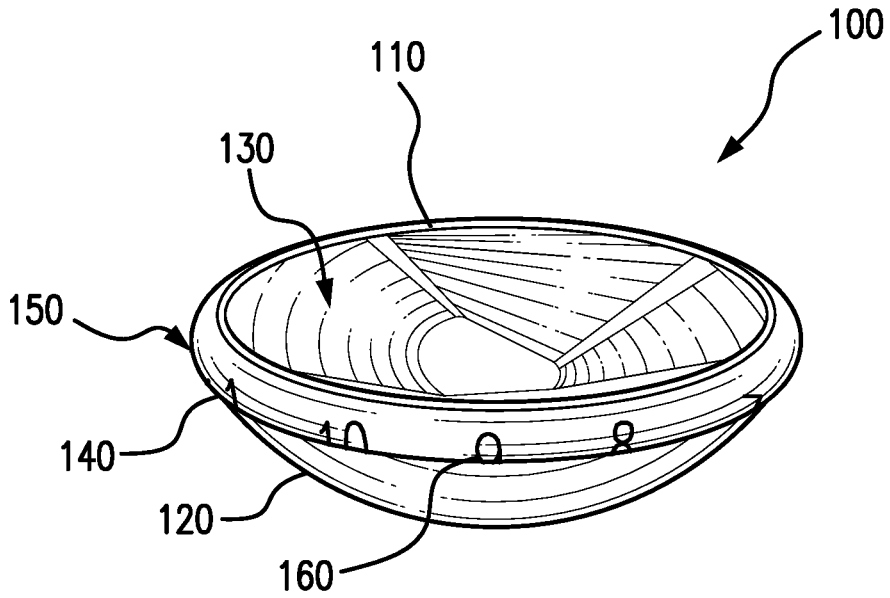
FIG. 1 is a perspective view of a device according to a first embodiment of the present invention.
Figure 2:
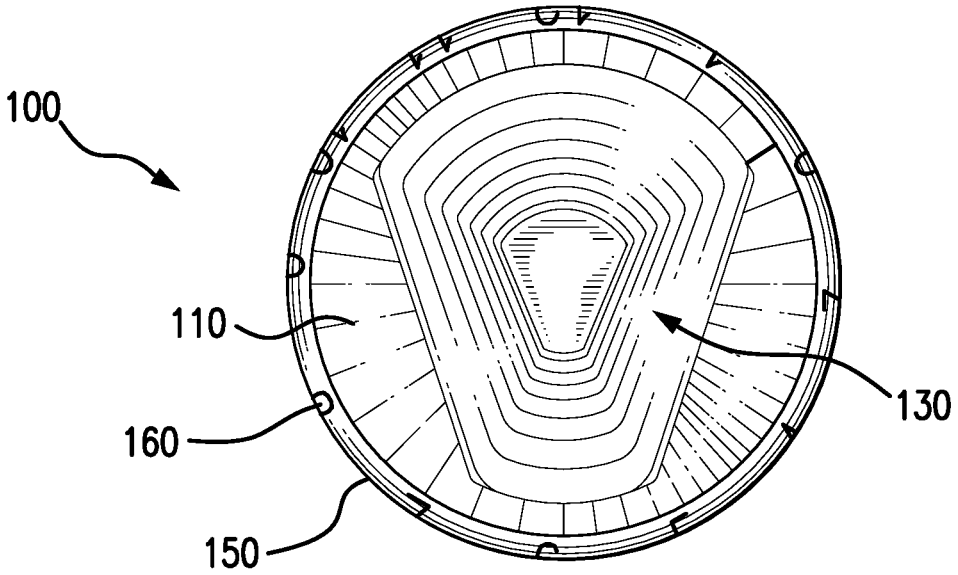
FIG. 2 is a top view of the device shown in FIG. 1.

Other features and aspects of the present invention will become more fully apparent from the following detailed description of some example embodiments, the appended claims, and the accompanying drawings.

DETAILED DESCRIPTION OF THE PREFERRED EMBODIMENTS

The inventor of the present application has recognized that there is a need for natural pain relief of lumbar, pelvic, and hip joints.

Referring to the Figures, FIGS. 1 to 4 illustrate a portable device for multidimensional mobilization of lumbar, pelvic, and hip joints in accordance with a first non-limiting embodiment of the present invention. The device 100 has a generally concave upper surface 110 connected to a generally convex lower surface 120. The generally concave upper surface has a recess 130 to cradle a sacrum, which is bilaterally symmetrical and elliptical, ovate, triangular, or trapezoidal in contour. The contour of the recess can be either elliptical, ovate, triangular, trapezoidal, or a combination of these contours. The recess is an indentation with a greater degree of concavity than the surrounding topography of the generally concave upper surface. The generally convex lower surface is designed for contact with the ground or other generally flat surface.

In accordance with non-limiting alternative embodiments of the invention, the device can be constructed of a single or multiple materials, including rubber, plastic, and/or wood. It is preferable for the outer surface of the device to have non-slip or non-skid properties, which can be achieved by the selection of materials, by the surface treatment of the materials selected, and/or coating of the outer surface with a non-slip or non-skid composition. The upper and lower surfaces of the device are generally non-deformable so as to control the degree of motion of the user. The upper and lower surfaces of the device may be of unitary construction, or in the alternative may be constructed separately and connected together. The device may be solid or hollow, so long as the device is generally non-deformable. Circumferential around the device is a peripheral edge 150 and/or optional sidewall.

The overall width, i.e. diameter, of the device of the first non-limiting embodiment is generally between about 6 inches to about 7 inches. The overall width of the device of other non-limiting alternative embodiments of the invention can vary widely from about 3 inches to about 12 inches. The overall height of the first non-limiting embodiment when the convex lower surface is in contact with the floor is generally between about 1.8 inches to about 2.5 inches. The overall height of the device of other non-limiting alternative embodiments of the invention can vary widely from about 0.75 inches to about 3.0 inches.

In accordance with non-limiting alternative embodiments of the invention, indicia 160 such as numbers, letters, and/or symbols are graphically depicted on the upper surface, peripheral edge, and/or optional sidewall of the device to provide the user with a frame of reference for positioning and/or utilizing the device. For example, in preferred non-limiting embodiments of the present invention, numbers of a clock are graphically depicted on the upper surface, peripheral edge, and/or optional sidewall of the device to simulate the face of a clock in order to provide the user with a frame of reference for positioning and/or utilizing the device. In other preferred non-limiting embodiments of the present invention, letters and arrows of a compass are graphically depicted on the upper surface, peripheral edge, and/or optional sidewall of the device to provide the user with a frame of reference for positioning and/or utilizing the device.

Figure 5A:
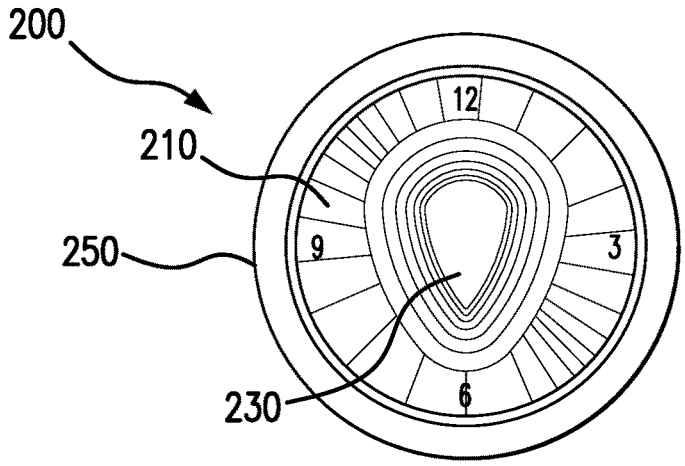
FIGS. 5A to 5C are top views of alternative embodiments of the present invention.
Figure 5B:
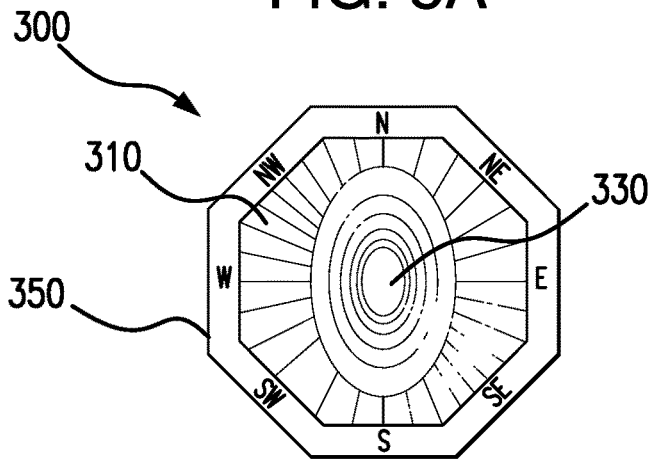
Figure 5C:
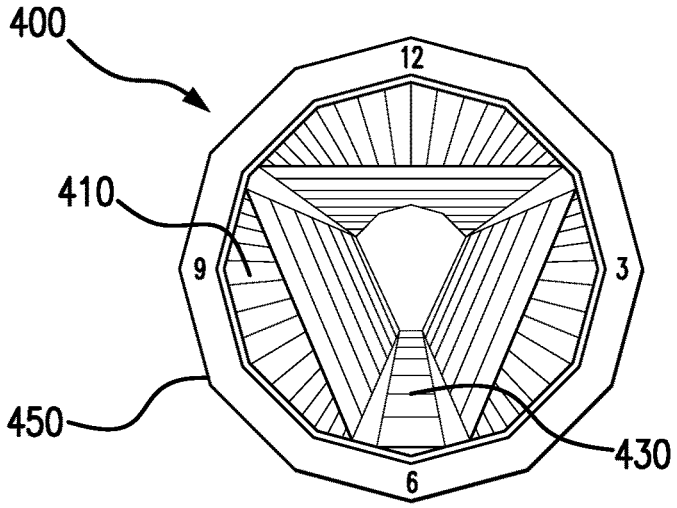

In accordance with non-limiting alternative embodiments of the invention, within the general concavity of the upper surface is a recess to cradle the sacrum, which is illustrated by way of examples in the illustrations of the devices 200, 300, 400 shown in FIGS. 5A to 5C. The recess 230, 330, 430 provides the user with greater control of the device when performing all of the motions. In a non-limiting alternative embodiment of the invention shown in FIG. 5A, the recess 230 of the generally concave upper surface 210 has a generally ovate contour, like for example the longitudinal section of an egg. In a non-limiting alternative embodiment of the invention shown in FIG. 5B, the recess 330 of the generally concave upper surface 310 has a generally elliptical contour. In a non-limiting alternative embodiment of the invention, the recess of the generally concave upper surface has a generally triangular contour, preferably wherein the triangle's base angles are approximately congruent to each other so that a generally isosceles triangle contour is formed. In another non-limiting alternative embodiment of the invention shown in FIG. 5C, the recess 430 of the generally concave upper surface 410 has a generally trapezoidal contour, like for example a trapezoid having two parallel base line segments and two non-parallel side line segments. It is preferred that each of the trapezoid base angles are approximately congruent so that a generally isosceles trapezoid is formed. In yet other non-limiting alternative embodiments of the invention, the recess of the generally concave upper surface has a generally ovate contour and a generally trapezoidal contour, like for example a trapezoid having four generally convex arcs so that the otherwise parallel base line segments and non-parallel side line segments curve outwardly. Unlike two-dimensional ovate and trapezoidal shapes, the upper surface is recessed in three-dimension to form an indentation in the center of the recess having an increased depth. The slope of the indentation of the recess from the generally concave upper surface to the depth of the recess may be gradual or extreme so as to cradle the sacrum.

As illustrated in FIG. 5, the peripheral edge 250, 350, 450 of the device 200, 300, 400 in accordance with non-limiting alternative embodiments of the invention may be smooth (as shown in FIG. 5A) or may have sides (as shown in FIG. 5B with 8 sides and as shown in FIG. 5C with 12 sides).

In non-limiting alternative embodiments of the invention, the convex lower surface may be half a sphere in overall shape, such that cross sections of the half sphere are spherical and either completely smooth or have a preset pattern of ridges, grooves, or planar strips. In non-limiting alternative embodiments of the present invention, the half semicircular sphere may be a half spherical polyhedron having a number of regions formed by the pre-set pattern of ridges, grooves, or planar portions. In preferred non-limiting alternative embodiments, the pre-set pattern of ridges, grooves, or planar portions form an even number of regions, most preferably four, six, eight, or twelve regions. In further non-limiting alternative embodiments of the present invention, the pre-set pattern of ridges, grooves, or planar portions converge at the nadir of the half spherical polyhedron. In further non-limiting alternative embodiments of the present invention, the preset pattern of ridges, grooves, or planar portions do not converge at the nadir of the half spherical polyhedron such that the nadir is smooth.

Figure 3:
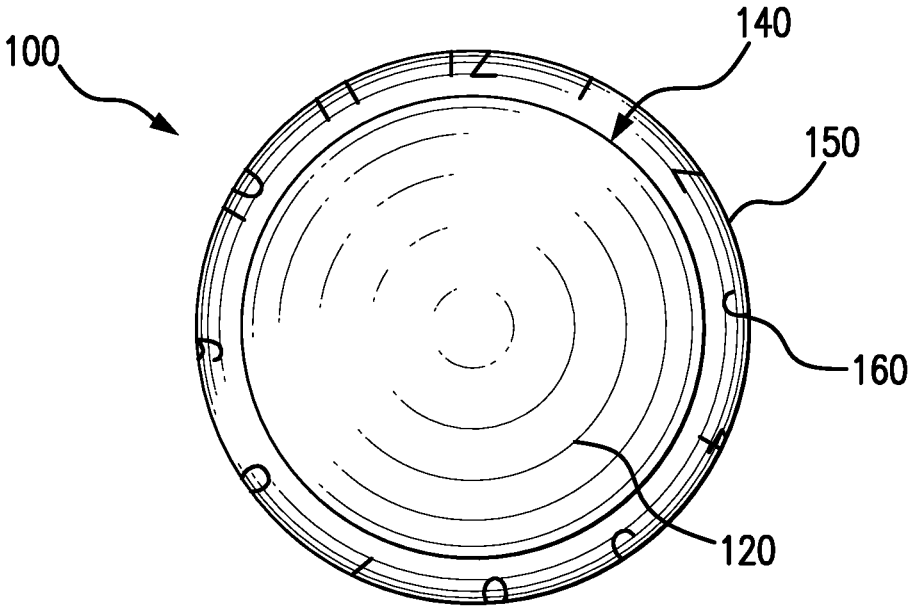
FIG. 3 is a bottom view of the device shown in FIG. 1.
Figure 4:
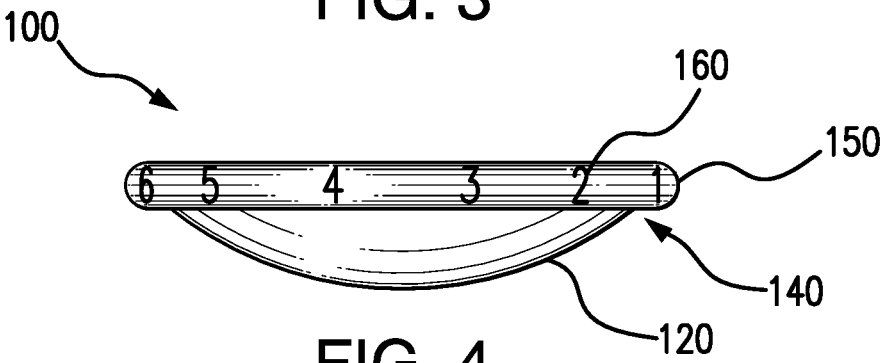
FIG. 4 is a side view of the device shown in FIG. 1.
Figure 6A:
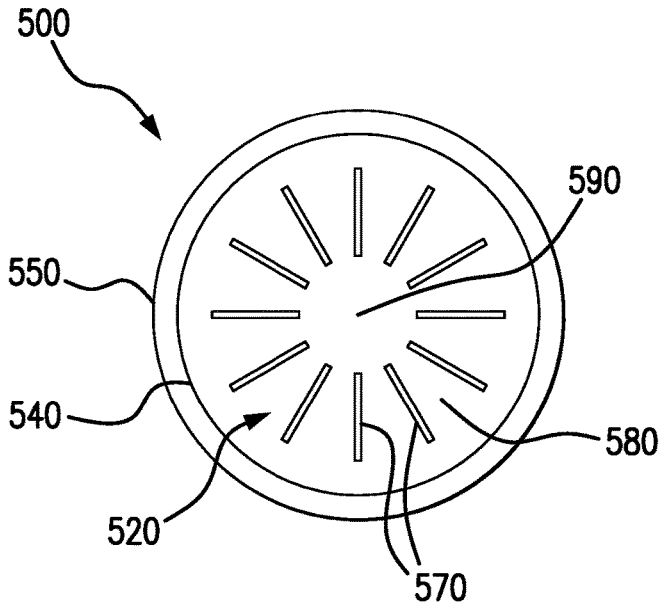
FIGS. 6A to 6C are bottom views of alternative embodiments of the present invention.
Figure 6B:
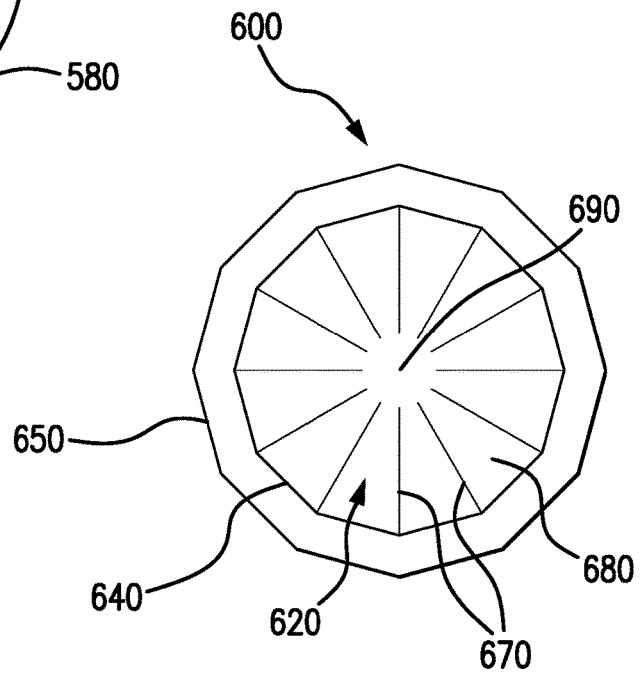
Figure 6C:
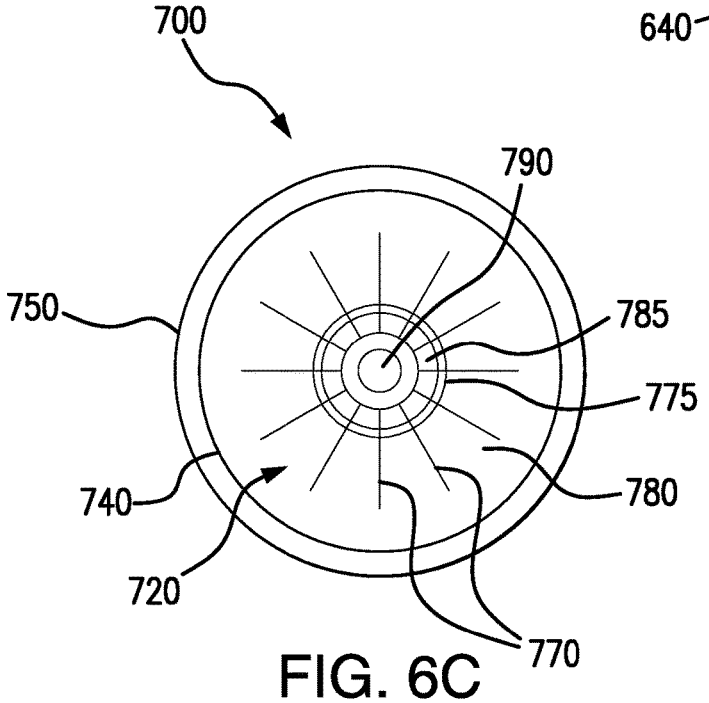

In a preferred non-limiting embodiment of the invention, as illustrated in FIGS. 1, 3 and 4, the convex lower surface 120 is spherical and smooth. The overall shape of the convex lower surface may be semicircular with either high or low degree of curvature. In non-limiting alternative embodiments of the invention, the contour of the lower surface is illustrated by way of examples in FIGS. 6A to 6C. In a non-limiting alternative embodiment of the invention shown in FIG. 6A, the peripheral edge 550 of the device 500 is round and the generally convex lower surface 520 is spherical with a pre-set pattern of planar strips 570 radially extending from near the nadir 590 of the lower surface to near the lip 540. In this example, there are twelve planar strips 570 forming twelve regions 580 as well as a smooth nadir region of the half spherical polyhedron. In a non-limiting alternative embodiment of the invention shown in FIG. 6B, the peripheral edge 650 of the device 600 is twelve-sided. The convex lower surface 620 of the device 600 has a pre-set pattern of grooves 670 radially extending from near the nadir 690 of the lower surface to the lip 640. In this example, there are twelve regions 680 between the grooves as well as a smooth nadir region of the half spherical polyhedron. In a non-limiting alternative embodiment of the invention shown in FIG. 6C, the peripheral edge 750 of the device 700 is round and the generally convex lower surface 720 is spherical with a pre-set pattern of radially extending ridges 770 that extend from near the nadir 790 of the lower surface to near the lip 740. In this example, the convex lower surface also has a pre-set pattern of concentric ridges 775. The concentric ridges, grooves, or planer strips may or may not overlap with the radially extending ridges, grooves, or planar strips. In this example, three of the four concentric ridges 775 overlap with the radially extending ridges 770 and one of the concentric ridges does not overlap with any of the radially extending ridges 775.

In non-limiting alternative embodiments of the present invention, the concentric ridges, grooves, and planar strips denote changes in degree of curvature of the convex lower surface of the device so that a user will feel a crossing of a threshold while moving in a particular direction over the ridge, groove, or planar strip. The circumferential ridge, groove, or planar strip also assists the user in maintaining the same degree of tilt on rotation.

As illustrated in FIG. 1, the upper surface and the lower surface are connected in such a manner as to limit the pelvic tilt when in use to between about 25 to about 30 degrees in any direction of movement of the pelvis from a neutral position.

In non-limiting alternative embodiments of the invention, the diameter of the upper surface is greater than the diameter of the lower surface, creating a lip such that the dimension of the lip relative to the upper surface and the lower surface is used to predetermine the maximum degree of tilt of the device. In a preferred non-limiting embodiment of the invention, there is a lip formed between the lower peripheral surface of the upper concave surface and the convex lower surface. As the device is tilted from a neutral position whereby the generally concave upper surface is substantially parallel to the floor to a position whereby the generally concave upper surface is at between about 25 to about 30 degrees due to the contact of the lower peripheral surface to the floor that stops further tilting beyond about 25 to about 30 degrees.

Figure 7A:
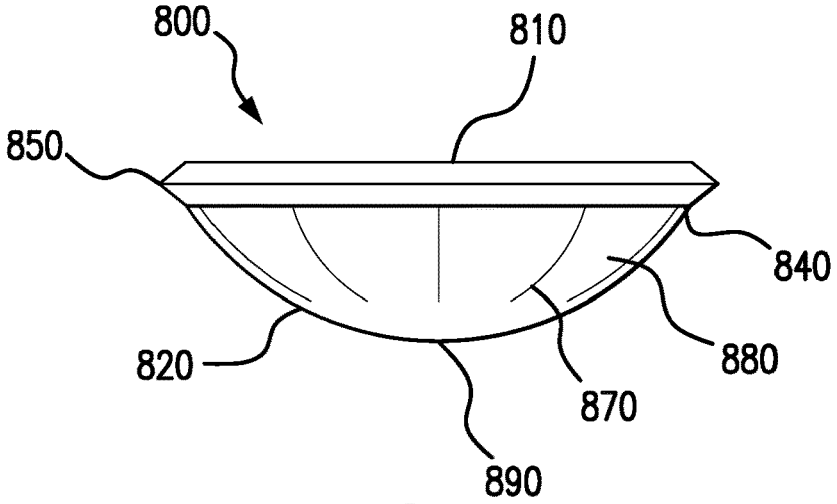
FIGS. 7A to 7C are side views of alternative embodiments of the invention.
Figure 7B:
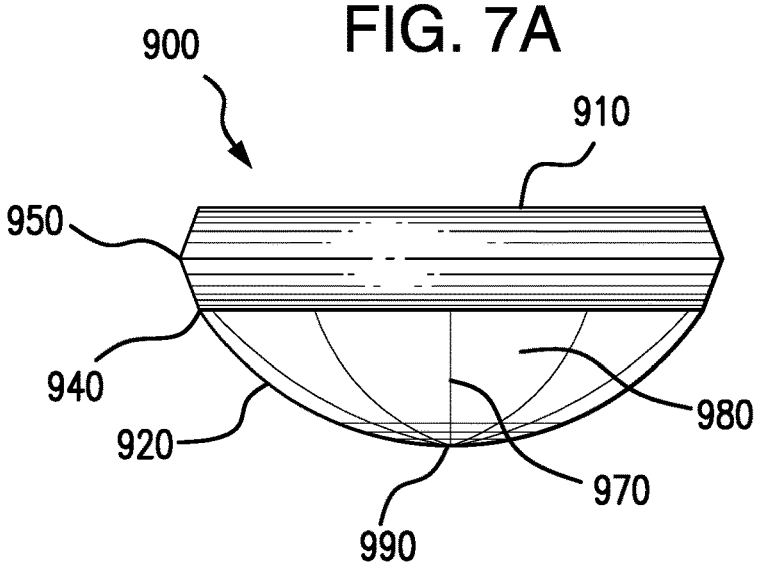
Figure 7C:
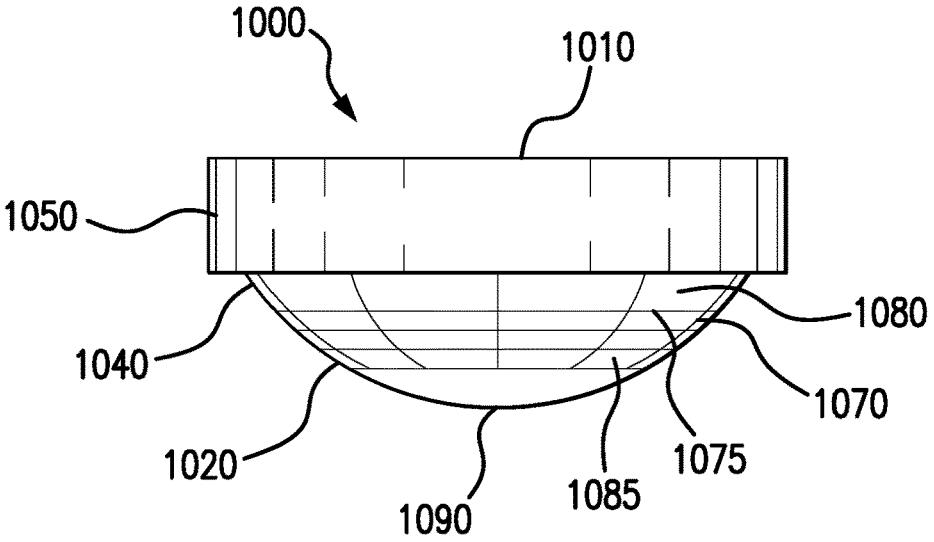

In non-limiting alternative embodiments of the invention, the peripheral edge of the device may form an acute or an obtuse curvature, or may be generally planar forming a sidewall as illustrated by way of examples shown in FIGS. 7A to 7C. In a non-limiting alternative embodiment of the invention shown in FIG. 7A, the peripheral edge 850 has an acute curvature between the generally concave upper surface 810 and the lip 840 of the device 800. In this example, the lower surface 820 has a radially extending ridges, grooves or planar strips 870 that extend from near the nadir 890 to the lip 840 forming regions 880 as well as a smooth nadir region. In a non-limiting alternative embodiment of the invention shown in FIG. 7B, the peripheral edge 950 has an obtuse curvature between the generally concave upper surface 910 and the lip 940 of the device 900. In this example, the lower surface 920 has a radially extending ridges, grooves, or planar strips 970 that extend from the nadir 990 to the lip 940 forming regions 980. In a non-limiting alternative embodiment of the invention shown in FIG. 7C, the peripheral edge is a planar sidewall 1050 between the generally concave upper surface 1010 and the lip 1040 of the device 1000. In this example, the lower surface 1020 has a radially extending ridges, grooves, or planar strips 1070 that extend from near the nadir 1090 to the lip 1040 forming regions 1080 as well as a smooth nadir region. In addition, the lower surface 1020 has four concentric ridges, grooves, or planar strips 1075 that overlap with the radially extending ridges, grooves, or planar strips 1070 to form regions 1085.

In non-limiting alternative embodiments of the invention, all of the top, bottom, and peripheral designs illustrated in FIGS. 1 to 7 are interchangeable with each other.

Figure 8:
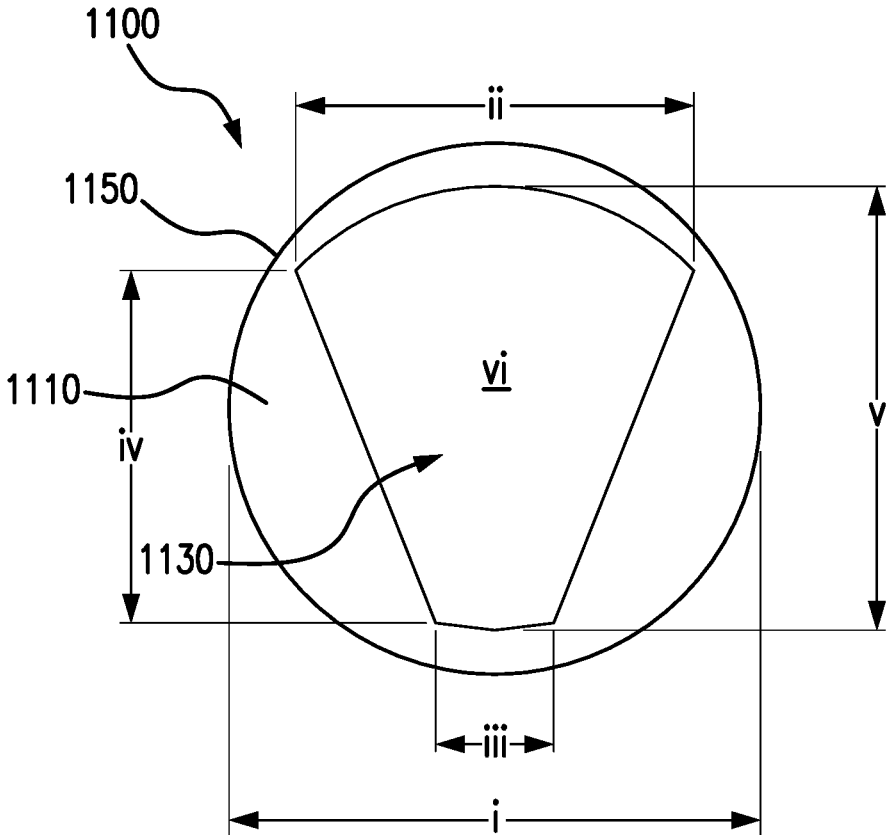
FIG. 8 is a schematic top view of a non-limiting alternative embodiment of the present invention.

By way of example, a non-limiting alternative embodiment of the present invention is illustrated in a schematic top view in FIG. 8. The generally upper concave surface 1110 of the device 1100 is approximately 6 inches in overall diameter i having a recess 1130 that is generally ovate-trapezoidal in contour with a top base arc length ii of about 4.5", with an opposite bottom base arc length iii of about 1.5", with left and right side arc lengths iv connecting the top and bottom base arcs of about 4", with a distance v between the top base arc and bottom base arc is about 5", and with a depth vi of the indentation of the recess of about ¾" to about 1¼".

Optionally, straps may be attached to the device, preferably attached to the peripheral edge or sidewall of the device, for wearing the device in the appropriate location on the user. In other non-limiting alternative embodiments, the device is inserted and fixed inside of a pouch with straps for wearing the device.

Figure 9:
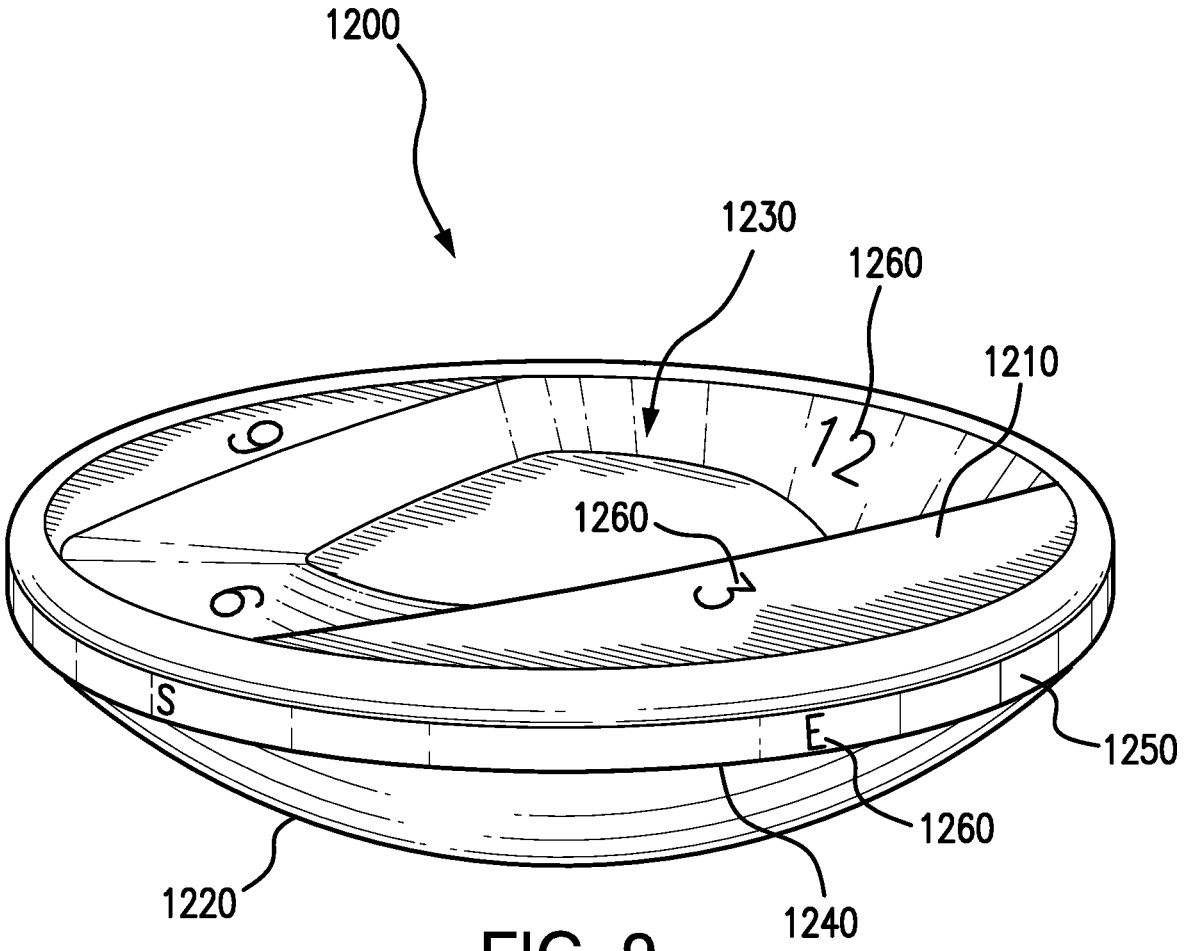
FIG. 9 is a perspective view of a device according to a non-limiting alternative embodiment of the present invention.
Figure 10:
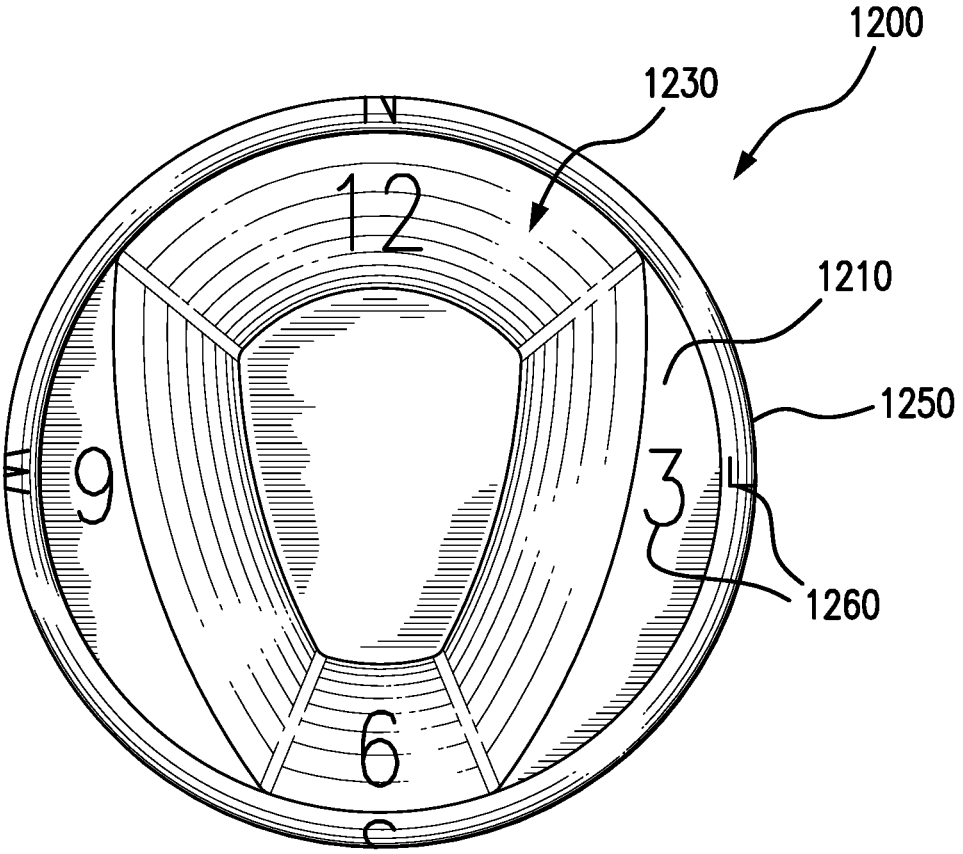
FIG. 10 is a top view of the device of FIG. 9.
Figure 11:
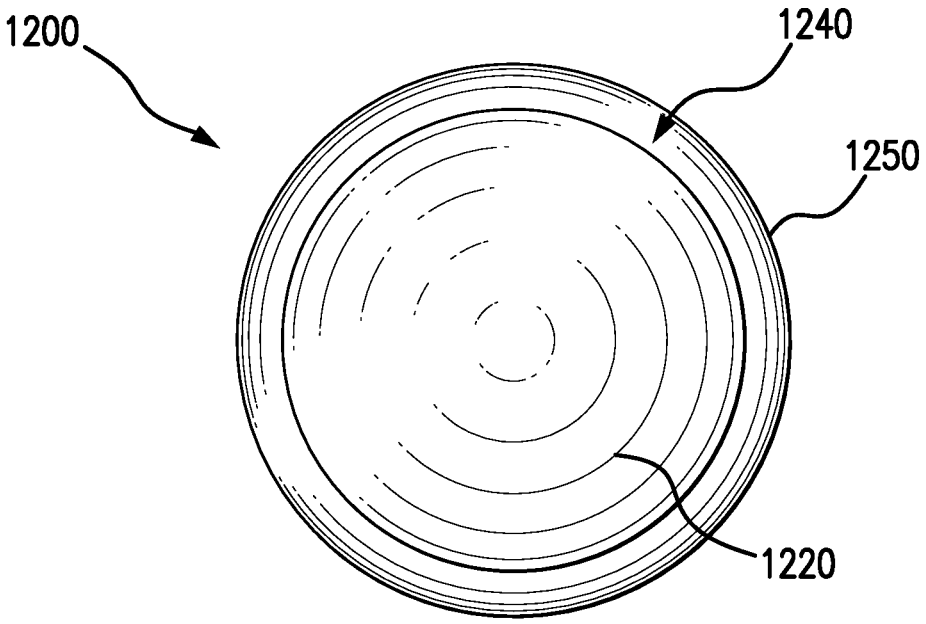
FIG. 11 is a bottom view of the device of FIG. 9.
Figure 12:
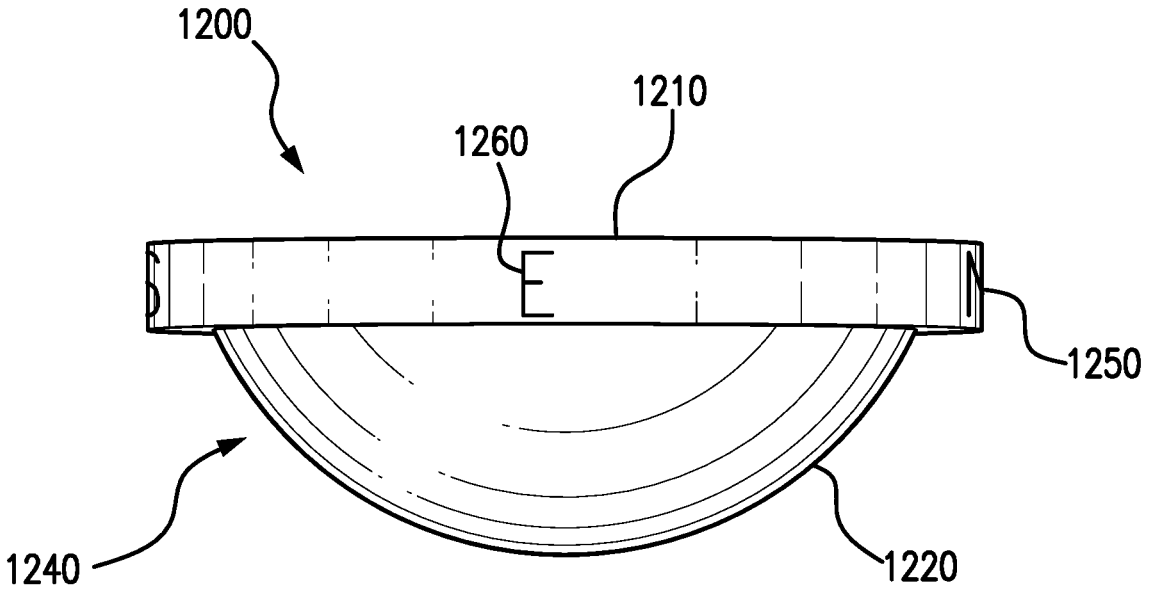
FIG. 12 is a side view of the device of FIG. 9.

In another non-limiting alternative embodiment of the invention, the device 1200 illustrated in FIGS. 9 to 12 has a generally concave upper surface 1210, a generally convex lower surface 1220, and a recess 1230 in the generally concave upper surface 1210 to cradle a sacrum. In this embodiment, the top base arc and the bottom base arc of the recess 1230 extend to the peripheral edge 1250 of the device 1200. The generally concave upper surface 1210, the recess 1230, and the peripheral sidewall 1250 all have indicia 1260. As also shown in FIG. 9, the device 1200 has indicia 1260 on the generally concave upper surface 1210 and in the recess 1230 representing the numbers of a face of a clock and has indicia 1260 on the peripheral edge 1250 of the device 1200 representing directions of a compass.

The device allows tilting, rocking, swaying, rotation, oscillation, and a variety of combinations of multidimensional movements, including nutation or counter-nutation of the sacroiliac joint.

All of the motions of the pelvic girdle—anterior tilt, posterior tilt, lateral tilt, diagonal tilt, rotation, nutation, and counter-nutation of the sacroiliac joint—can be performed with the device. It is believed that the elevation and curvature of the upper surface and the curvature of the lower surface of the device together provide an even greater therapeutic benefit to an individual than any known method.

In accordance with non-limiting embodiments of the present invention, the following are examples of exercise regimens using the device illustrated in FIG. 1. As with any exercise regimen, and particularly for physical rehabilitation, physical therapy, and sports medicine, the subject should first consult a physician or other health care professional.

Before starting any of the exercises described below, the subject should get ready by first lying down on his or her back on a flat surface with feet flat and knees bent for about 1 to about 2 minutes to relax the pelvic region. Then, before placing the device between the subject's sacrum and the floor, the subject should slowly lift his or her pelvis about 1 to about 3 inches up from the flat surface about 5 to about 10 times. Once the device is in position, the subject should again relax the pelvic region for about 1 to about 2 minutes in a neutral position.

The subject lies flat with the subject's back on the floor, with the subject's feet flat on floor, and with the subject's knees elevated. The subject's feet are generally hip/shoulder width apart. Subject places the device illustrated in FIG. 1 under the subject's sacrum, such that the recess in the upper surface cradle's the subject's sacrum and the convex lower surface of the device is in contact with the floor. Since the device of FIG. 1 also contains the optional design feature of having numbers of the face of a clock on the peripheral edge of the device, the device should be oriented in a manner such that the 12 o'clock is oriented under the subject's sacrum in a direction pointing towards the subject's head. This is a starting position that represents a significant improvement over all known methods because the subject begins a series of alternative movements of the lower back, hip, and pelvis starting from an elevated resting position. Even before the subject begins, maintaining the hip and pelvis in an elevated yet neutral position causes an initial stretch of the L4-L5 lumbar segment, L5-S1 lumbosacral joint, sacroiliac joint and the pubic symphysis, hip joints, and surrounding muscles.

Before the subject begins a series of alternating movements, the subject must get set by letting go of all tension in the subject's neck, shoulders, and back. This allows for a priming stretch of the pelvic and hip joints as well as the surrounding muscles.

The subject is now ready to go to perform the following exercises using a device in accordance with the present invention. The number of repetitions, body proportions, and length of practice may vary for each person depending on affected side, location of a tight spot, physical condition, age, gender, and degree of pain. The goal is to perform all of these exercises within a pain free range of motion, with the expectation that the pain free range of motion will increase until the subject is completely pain free.

Anterior Pelvic Tilt.

From the initial elevated position, the subject performs an anterior pelvic tilt. The subject stretches the lower back, pelvis, and hips in a direction that increases lumbar lordosis. Spinal, lumbar, hip extension, and nutation of the sacroiliac joint occurs during the anterior pelvic tilt. This anterior pelvic tilt stretch represents a significant improvement over all known methods because the subject can increase the lumbar lordosis to a higher degree than if the subject started from a position of lying flat. Further, in order to achieve the same or similar degree of lumbar lordosis without the use of the device illustrated in FIG. 1, for example, the subject would have had to engage muscles to lift the pelvic girdle, which contra muscle activation limits the benefits the anterior pelvic tilt more than if the subject used the device illustrated in FIG. 1. After the initial anterior pelvic tilt is performed, the subject then returns to the neutral position.

Posterior Pelvic Tilt.

From the neutral position resting on the device illustrated in FIG. 1, the subject performs a posterior pelvic tilt. Spinal, lumbar, hip flexion, and counter-nutation of the sacroiliac joint occurs during this posterior pelvic tilt. The subject stretches the lower back, pelvis, and hips in a direction that decreases lumbar lordosis. In a similar way, this posterior pelvic tilt stretch represents a significant improvement over all know methods for the same reasons. After the initial posterior pelvic tilt is performed, the subject returns to the neutral position.

The subject would then alternate between anterior and posterior pelvic tilts. After 10 to 20 repetitions, the subject would move on to left and right lateral pelvic tilts.

Left and Right Lateral Pelvic Tilts.

In the same manner as described for anterior and posterior pelvic tilts, the subject would stretch in a lateral direction to the left and alternate with a stretch in a lateral direction to the right. The subject would alternate between left and right lateral pelvic tilts. External and internal hip rotation occurs as soon as the femur bones of a user's legs start to sway right and left. After 10 to 20 repetitions, the subject would move on to pelvic and hip rotation.

Pelvic and Hip Rotation.

Imagining that the axis of rotation extends through the subject's belly button through the center of the device illustrated in FIG. 1, for example, to the floor, the subject would first stretch in any initial direction (anterior, posterior, lateral left, or lateral right pelvic tilt), and then rotate the subject's pelvis and hips in a circular manner around the center of rotation. This pelvic and hip rotation represents a significant improvement over all known methods because the rotation is performed at a higher degree than if the subject were lying on a flat surface. Similarly, as discussed above, the subject does not need to engage contra muscles to lift the pelvis and hips as the rotation is performed. The subject would alternate in clockwise and counterclockwise directions of rotation. After 10-20 repetitions in alternating directions, the subject returns to the neutral position. From the neutral position, the subject would move on to perform segmented rotations or diagonal pelvic tilts.

Segmented Rotation.

Segmented rotation is performed by the subject in the same manner as a pelvic and hip rotation described above, except that the subject rotates the hips for only a portion of the full rotation. So, for example, an alternating segmented rotation may alternate in clockwise and counterclockwise directions of rotation for only one half of a full rotation. In another alternative, an alternating segmented rotation may alternate in clockwise and counterclockwise directions of rotation for only one quarter of a full rotation. This will focus the stretch in a particular region.

Diagonal Pelvic Tilts.

In the same manner as described for anterior and posterior pelvic tilts and for left and right lateral pelvic tilts, the subject would stretch in a 1 to 7, 5 to 11, 2 to 8, and 10 to 4 pattern. Using as a guide the numbers of a clock as graphically depicted on the peripheral edge of the device illustrated in FIG. 1, for example, the subject would stretch in a direction from the neutral position in the direction of 1 o'clock and alternate with a stretch in a direction of 7 o'clock, and so forth. Spinal, lumbar, and hip extension and flexion occurs during diagonal pelvic tilts.

EXAMPLE

First Trial.

Subject 1 suffered from chronic Spinal Stenosis, Sciatica, Spondylolysis (L4-L5), and Spondylolesthesis (L4-L5) with chronic pain (level 8) in the groin, buttock, and radiating into the left leg, and used known methods of stretching (20 lateral tilts, 20 anterior and posterior tilts, 20 pelvic and hip rotations, 20 diagonal tilts (1-7 directions), 20 segmented rotations (between positions 12-3 and between positions 6-9)) on a flat surface daily for a one month period of time for the first trial. During the study, Subject 1 recorded the level of pain before and after stretching on a pain scale of 0-10 (0=no pain, 2=mild pain, 4=moderate pain, 6=severe pain. 8=very severe pain, and 10=worst possible pain) and noted the amount of pain medicine taken in the prior 24 hour period.

Results.

Performing the stretches on a flat surface and using traditional stretching methods, Subject 1 reported a pain level of 8 at the start of the first trial and reported a pain level of 4 at the end of the first trial 30 days later. At the start of the first trial, Subject 1 reported taking on average six 200 mg tablets of Ibuprofen per day. At the end of the first trial 30 days later, Subject 1 reported taking on average three 200 mg tablets of Ibuprofen per day. One month after concluding the first trial, Subject 1 reported a pain level of 8 and reported taking on average six 200 mg tablets of Ibuprofen per day. (See Table 1 below.)

Second Trial.

Subject 1 used the device illustrated in FIG. 1 daily for a one month period of time using the methods of stretching (20 lateral tilts, 20 anterior and posterior tilts, 20 pelvic and hip rotations, 20 diagonal tilts (1-7 directions), 20 segmented rotations (between positions 12-3 and between positions 6-9)) on a flat surface in accordance with the present invention for the second trial. During the study, Subject 1 recorded level of pain before and after stretching on a pain scale of 0-10 (0=no pain, 2=mild pain, 4=moderate pain, 6=severe pain. 8=very severe pain, and 10=worst possible pain) and noted the amount of pain medicine taken in the prior 24 hour period.

Results.

Performing the stretches using the device illustrated in FIG. 1 and using the stretching methods in accordance with the present invention, Subject 1 reported a pain level of 8 at the start of the second trial and reported a pain level of 0 at the end of the second trial 30 days later. At the start of the second trial, Subject 1 reported taking on average six 200 mg tablets of Ibuprofen per day. At the end of the second trial, Subject 1 reported taking no pain medication. Surprisingly, Subject 1 reported a pain level of 0 and reported taking no pain medication over the next 4 months after concluding the second trial. (See Table 1 below.)

As demonstrated in Table 1, the effectiveness and the duration of pain relief of the second trial far exceeded the recuperative benefits of the first trial. By the end of the first trial, Subject 1 went from a pain level of level 8 (very severe pain) to a level 4 (moderate pain) and reduced pain medication in half. Within one month after the conclusion of the first trial, the pain level returned to the original level 8 and the need for pain medication returned to the original level of six 200 mg/day tablets of Ibuprofen. By the end of the second trial, Subject 1 went from a pain level of 8 (very severe pain) to a level 0 (no pain) and reduced pain medication completely. Not only does the second trial represent a dramatic improvement of pain relief over the first trial, but the second trial also demonstrated greater than expected results when the complete pain relief continued for 4 consecutive months after the end of the second trial.

TABLE 1

| Subject 1 | Timeline | Pain Scale | Medication Dosage (on average everyday) |
|---|---|---|---|
| | Before First Trial | 8 | 6 × 200 mg/day |
| First Trial | Starts | 8 | 6 × 200 mg/day |
| First Trial | Ends (1 Month Later) | 4 | 3 × 200 mg/day |
| | 1 Month After First Trial Ends | 8 | 6 × 200 mg/day |
| | Before Second Trial | 8 | 6 × 200 mg/day |
| Second Trial | Starts | 8 | 6 × 200 mg/day |
| Second Trial | Ends (1 Month Later) | 0 | No Medication |
| | 1 Month After Second Trial Ends | 0 | No Medication |
| | 2 Months After Second Trial Ends | 0 | No Medication |
| | 3 Months After Second Trial Ends | 0 | No Medication |
| | 4 Months After Second Trial Ends | 0 | No Medication |

Pain Scale: 0 = no pain, 2 = mild pain, 4 = moderate pain, 6 = severe pain. 8 = very severe pain, and 10 = worst possible pain.

The invention is not restricted to the embodiments described, but, on the contrary, covers any modification on form and any alternative form of embodiment that falls within the scope and spirit of the present invention. While there have been described what are believed to be preferred embodiments of the invention, those skilled in the art will recognize that other and further modifications may be made thereto, without departing from the spirit and scope of the present invention, as defined by the following claims.

What is claimed is:

1. A device for multidimensional mobilization of lumbar, pelvic, and hip joints comprising an upper surface, a peripheral edge, and a lower surface, wherein the upper surface within the peripheral edge consists essentially of a generally concave upper surface and a recess to cradle a sacrum within said generally concave upper surface, wherein the lower surface within the peripheral edge consists essentially of a generally convex lower surface, wherein the convex lower surface has a pre-set pattern of ridges, grooves, or planar portions, and wherein the pre-set pattern of ridges, grooves, or planar portions are generally equidistant and form a half spherical polyhedron with twelve regions.

2. A device for multidimensional mobilization of lumbar, pelvic, and hip joints comprising an upper surface, a peripheral edge, and a lower surface, wherein the upper surface within the peripheral edge consists essentially of a generally concave upper surface and a recess to cradle a sacrum within said generally concave upper surface, wherein the lower surface within the peripheral edge consists essentially of a generally convex lower surface, wherein the convex lower surface has a pre-set pattern of ridges, grooves, or planar portions, wherein the pre-set pattern of ridges, grooves, or planar portions are generally equidistant and form a half spherical polyhedron with twelve regions, and wherein the ridges, grooves, or planar portions converge at a nadir of the half spherical polyhedron.

* * * * *